United States Patent [19]

Morelli

[11] Patent Number: 4,677,772

[45] Date of Patent: Jul. 7, 1987

[54] EXCAVATOR WITH EXTENSIBLE BOOM

[76] Inventor: Aldo Morelli, 25 Rockwood Ter., Jamaica Plain, Mass. 02130

[21] Appl. No.: 798,983

[22] Filed: Jan. 9, 1986

[51] Int. Cl.[4] ..... E02F 5/02

[52] U.S. Cl. ..... 37/103; 414/718

[58] Field of Search ..... 37/103, 117.5; 214/711–713, 715, 718, 722, 723, 694

[56] References Cited

U.S. PATENT DOCUMENTS

| | | | |
|---|---|---|---|
| 3,166,205 | 1/1965 | Symmank | 414/694 |
| 3,445,015 | 5/1969 | Sampo et al. | 414/718 |
| 3,624,785 | 11/1971 | Wilson | 414/718 |
| 3,688,930 | 9/1972 | Shumaker | 414/718 |
| 3,871,538 | 3/1975 | Miller et al. | 414/718 |
| 4,142,308 | 3/1979 | Brandtjen | 37/103 |
| 4,264,265 | 4/1981 | Stoychoff | 414/718 |

FOREIGN PATENT DOCUMENTS

| | | | |
|---|---|---|---|
| 649235 | 9/1962 | Canada | 37/103 |
| 763273 | 7/1967 | Canada | 37/103 |
| 1428942 | 1/1966 | France | 37/103 |
| 101626 | 8/1980 | Japan | 37/103 |
| 868446 | 5/1961 | United Kingdom | 37/103 |
| 1,155,677 | 5/1985 | U.S.S.R. | 37/103 |

*Primary Examiner*—E. H. Eickholt

*Attorney, Agent, or Firm*—Robert T. Gammons

[57] ABSTRACT

An excavator comprising a beam pivotally supported at its proximal end to the platform of a mobile support for movement about a horizontal axis, telescopically interengaged upper and lower arms at the distal end of the beam, an excavator pivotally mounted to the distal end of the lower arm and hydraulic cylinders coupling the distal end of the lower arm to the distal end of the beam and the excavator to the distal end of the upper arm. The distal end of the lower arm is structured to mount a backhoe or shovel as may be required for a given operation.

8 Claims, 6 Drawing Figures

EXCAVATOR WITH EXTENSIBLE BOOM

BACKGROUND OF THE INVENTION

Conventionally, excavators comprise a beam pivotally mounted at its proximal end to a support for angular movement about a horizontal axis and an arm pivotally mounted at its proximal end to the distal end of the beam. In some instances, the pivot connecting the distal and proximal ends of the beam and arm is at the extremities of the respective beam and arm and the power-operated cylinder is disposed between the proximal end of the beam and intermediate the ends of the arm to effect articulation of the arm relative to the beam. In other instances, the arm is pivotally mounted intermediate its ends to the distal end of the beam and a power-operable cylinder is disposed between the proximal end of the beam and the proximal end of the arm. In both such structures, the shovel or backhoe is pivotally mounted to the distal end of the arm and there is power-operable means mounted to the arm for effecting movement of the shovel or backhoe. The disadvantage of such structures is that there is minimal mechanical advantage available for driving the shovel or backhoe, with the consequence that when resistance to operation is high, excessive stresses are developed in the beam and linkage which results in breakdowns. It is the purpose of this invention to provide an improved construction which will afford maximum mechanical advantage for the power input with minimal development of destructive stresses in the structure. Further objects are to provide a structure which will afford maximum depth range and is so structured as to enable the use of a shovel or backhoe with minimal conversion.

SUMMARY OF THE INVENTION

As herein illustrated, the excavator comprises a boom pivotally supported at its proximal end to the platform of a supporting chassis for movement about a horizontal axis, an excavator, and means supporting the excavator adjacent the distal end of the boom for rectilinear and pivotal movement relative to the distal end of the boom, comprising first means supporting the excavator adjacent the distal end of the boom for rectilinear and pivotal movement thereof relative to the distal end of the boom, first power-operable means operable to effect rectilinear movement of the excavator relative to said first means and second power-operable means operable to effect pivotal movement of the excavator relative to said first means. The first means in one form comprises a rigid upper arm, pivotally connected at one end to the distal end of the boom for pivotal movement about a horizontal axis spaced from the distal end of the boom and a rigid lower arm mounted to the distal end of the upper arm for rectilinear movement relative thereto, articulated links pivotally connected at their distal ends to, respectively, the distal end of the upper arm and to the distal end of the lower arm and the second power-operable means is pivotally connected to the distal end of the boom and to the articulation connecting the articulated links. There is an inextensible link pivotally connected at one end to the distal end of the upper arm and at its opposite end to the excavator at a radial distance from the pivot connecting the excavator to the distal end of the lower arm. Desirably, the upper arm is of hollow, tubular construction and the lower arm is telescopically mounted within the upper arm, together with the power-operable cylinder. Alternatively, the excavator comprises a single rigid supporting arm, pivotally connected at one end to the beam and means pivotally supporting the excavator at the other end thereof. The first power-operable means connects the distal end of the beam to the distal end of the supporting arm and the second power-operable means connects the excavator to the supporting arm. The articulated links connect the power-operable means, respectively, to the distal end of the support arm and to the excavator.

The invention will now be described with reference to the accompanying drawings, wherein.

Figure 1:
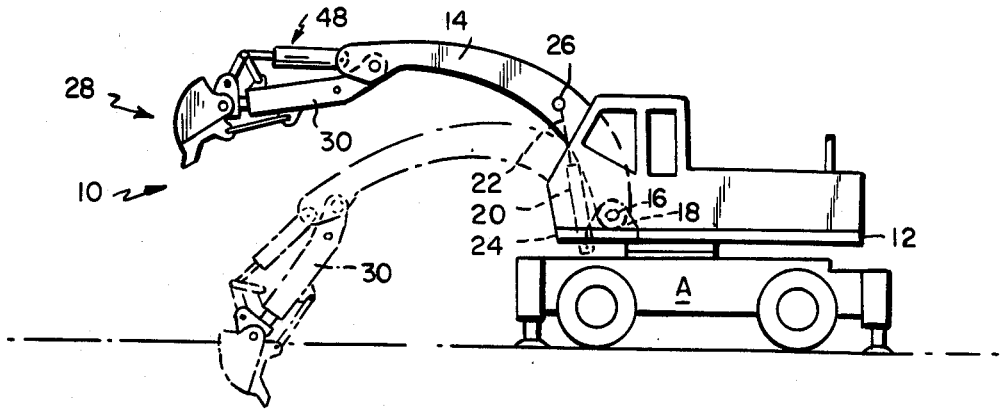
FIG. 1 is an elevation showing the excavator in one form mounted to the platform of a supporting chassis.
Figure 2:
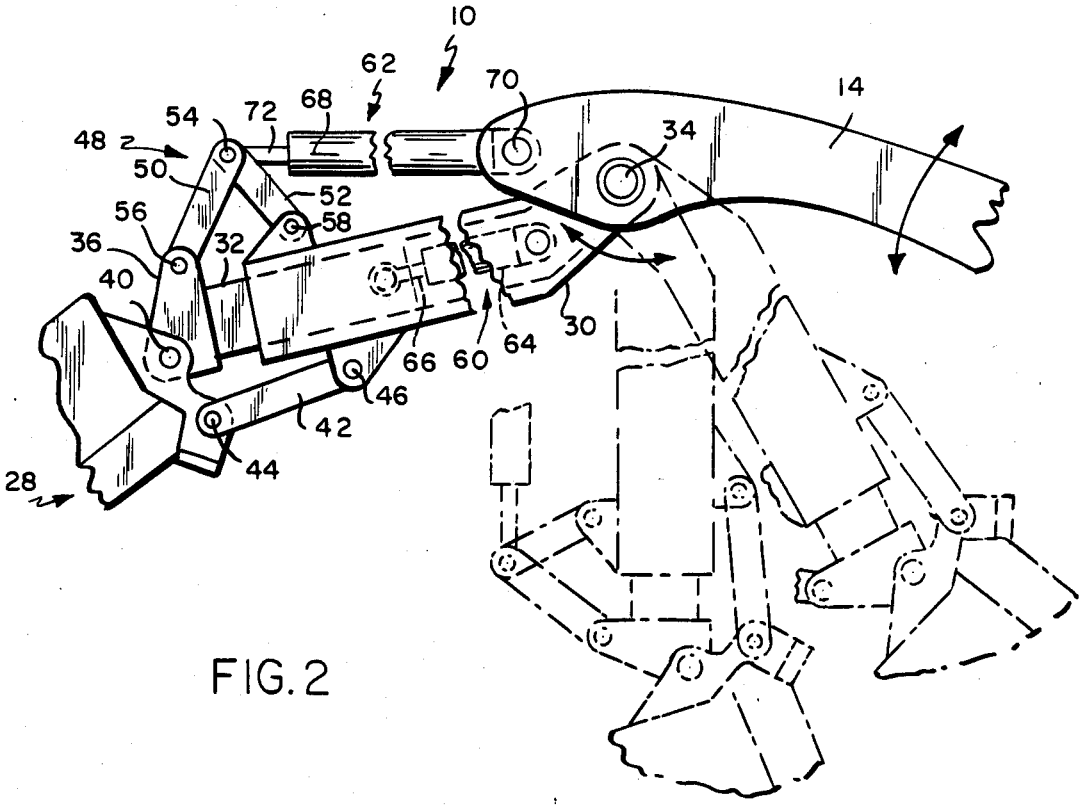
FIG. 2 is an elevation of the excavator to larger scale showing two positions of the excavator relative to its supporting boom.

Referring to the drawings, FIGS. 1 and 2, the excavator indicated generally by the reference character 10 is supported by a platform 12 mounted to an undercarriage A provided with wheels or tractor treads for motivation for rotation about a vertical axis. The excavator 10 comprises a main beam 14 of generally arcuate configuration, pivotally mounted at its proximal end 16 to a mounting bracket 18 fixed to the platform 12 for rotation about a horizontal axis. Rotation of the beam at its proximal end about its horizontal axis is effected by power-operable means comprising a hydraulic cylinder 20 and piston rod 22, the ends of which are pivotally connected at 24 to the bracket and at 26 to the beam. Desirably, there are two such hydraulic cylinders mounted in tranversely-spaced relation at opposite sides of the bracket 18 and hydraulic pressure is supplied to the cylinders 20-20 to effect elevation and depression of the beam 14. The cylinders and rods are so proportioned that the beam can be moved through an angle of more than 90° so that it has a range from a generally horizontal position to a substantially vertical position.

The excavator 10, FIG. 2, in the form of a bucket 28 is mounted to the distal end of the beam 24 for extension relative to the beam and for rotation relative to the beam. The mounting in one form, FIG. 2, comprises telescopically engaged upper and lower arms 30 and 32. The proximal end of the upper arm 30 is pivotally connected to the beam 14 at 34 spaced from the distal end of the beam 14 for pivotal movement about a horizontal axis. The lower arm 32 is telescopically mounted within the distal end of the upper arm 30 for rectilinear movement relative thereto and has at its distal end a mounting block 36 rigidly fixed thereto. The bucket 28 which may be of conventional construction is pivotally mounted at 40 to the block 36 below the longitudinal axis of the lower arm 32 for rotation about a horizontal axis. An inextensible link 42 is pivotally connected at one end 44 to the bucket below the pivot axis 40 and pivotally connected at its other end 46 to the distal end of the upper arm 30. Articulated linkage 48 comprising links 50 and 52 are pivotally connected at their proximal ends to each other at 54 and at their distal ends, respectively, at 56 to the block 36 and at 58 to the distal end of the upper arm 30.

Rectilinear and angular movement of the bucket 28 relative to the upper arm 30 is provided for by hydraulic piston and cylinder assemblies 60 and 62. The piston and cylinder assembly 60 comprises a cylinder 64 pivotally connected to the upper arm 30 and a piston rod 66 pivotally connected to the lower arm 32. The piston and cylinder assembly 62 comprises a cylinder 68 pivotally connected to the distal end of the beam at 70 and a rod 72 pivotally connected to the proximal ends of the links 50 and 52 at their place of articulation 54.

As thus structured, the piston and cylinder assembly 60 provides for effecting rectilinear movement of the bucket relative to the upper arm 30 and the piston and cylinder assembly 62 provides for rotation of the bucket relative to the upper and lower arms 30 and 32. As illustrated in FIG. 2, the bucket can be moved through an angle of at least 135° relative to the boom 14.

In the structure illustrated in FIGS. 1 and 2, the power cylinder 60 is housed within the upper arm which is hollow and provides the advantage that it is, to a great extent, protected from the environmental grit and abrasive material which is highly destructive.

Figure 3:
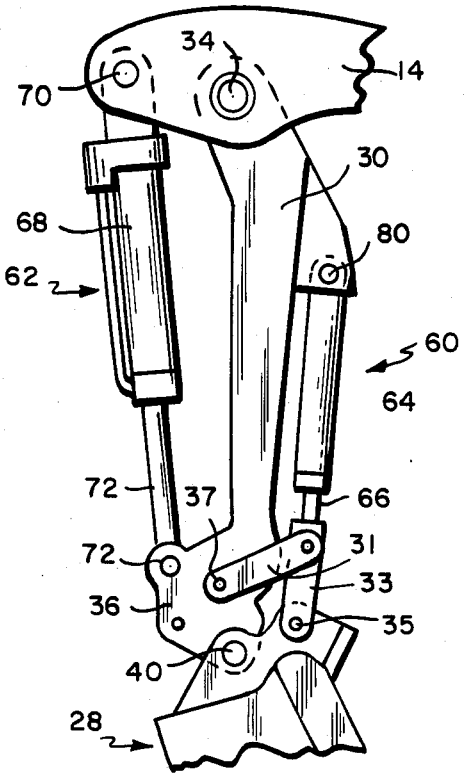
FIG. 3 is a fragmentary elevation of a modified structure.

Alternatively, the bucket 28 as shown in FIG. 3 may be pivotally connected at 40 to the block 36 at the distal end of the arm 30. In place of the lower arm 32, articulated links 31, 33 are pivotally connected at 35 and 37 to the bucket and block 36 and at their other ends to the piston rod 66 of a piston and cylinder assembly 70. The cylinder 64 is pivotally connected at 80 to the arm 30 adjacent its proximal end. The distal end of the arm 30 is connected to the distal end of the beam 14 by a piston and cylinder assembly 62 comprising a cylinder 68 connected at 70 to the beam and a rod 72 connected at 72 to the block 36.

Figure 4:
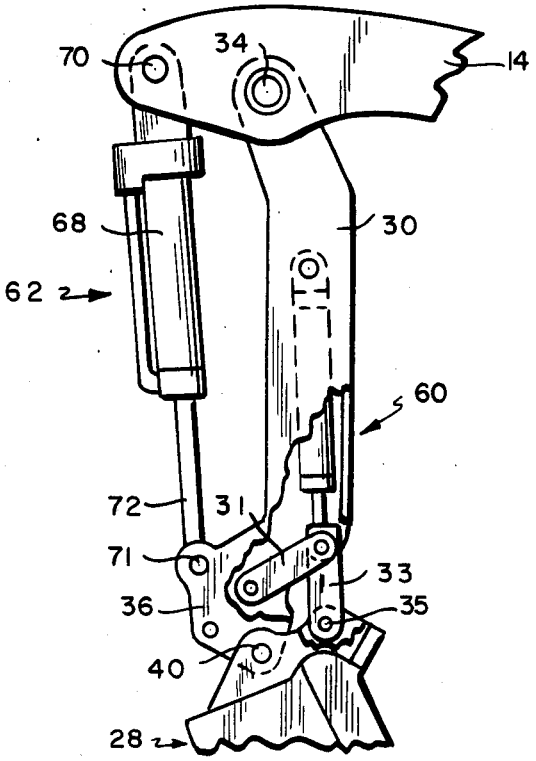
FIG. 4 is an elevation of a second modification.

In a further modification, FIG. 4, a hollow arm 30 is used, pivoted at its proximal end 34 to the beam 14 spaced from the end. The bucket 28 is pivotally connected at 40 to the block 36 at the distal end of the arm 30. The block 36 at the distal end of the arm 30 provides for connecting the distal end of the arm 30 to the distal end of the beam 14 by way of a piston and cylinder assembly 62 comprising a cylinder 68 and a piston 72. Articulated links 31,33 and a piston and cylinder assembly 60 connect the bucket 28 to the block 36 and the arm 30.

Figure 5:
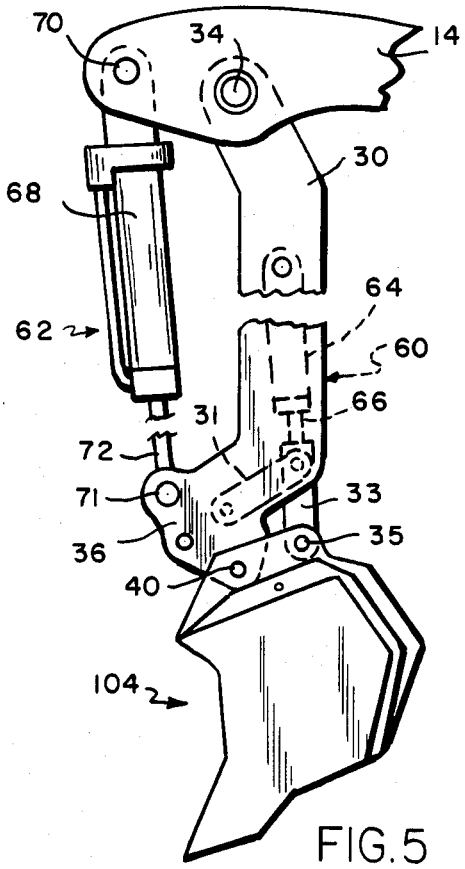
FIG. 5 is a fragmentary elevation showing a shovel mounting in place of a backhoe.

FIG. 5 illustrates a structure like that shown in FIG. 4 with a shovel 104 substituted for the backhoe or bucket 28.

Figure 6:
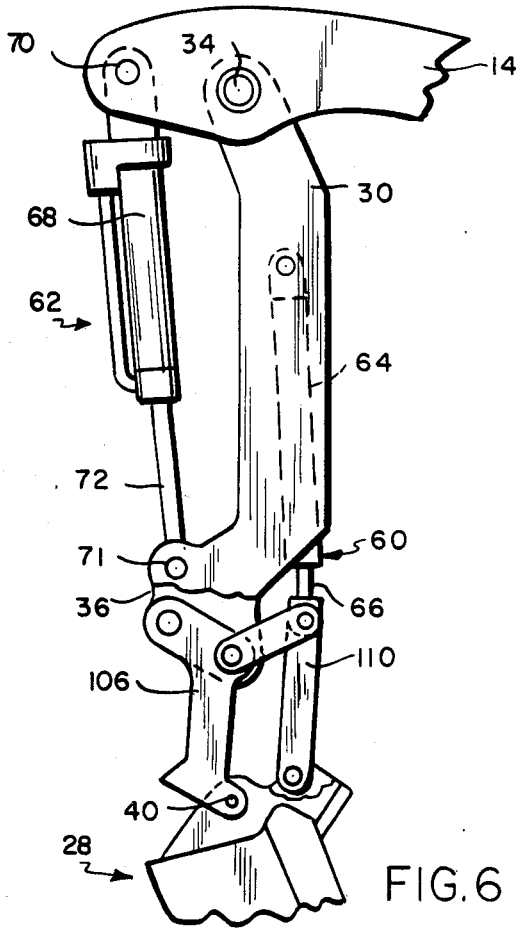
FIG. 6 is an elevation showing extension linkage for connecting the backhoe to the supporting arm.

FIG. 6 illustrates a structure like that shown in FIG. 4 provided with extensions in the form of a link 106 mounted to the block 36 and pivotally connected at 40 to the bucket 28 and a link 110 of extended length substituted for the link 33. This linkage 106,110 extends the reach of the backhoe or bucket.

Since the linkage supporting the excavator to the beam provides the clockwise or anti-clockwise movement relative to the distal end of the beam, the structure is capable of use as a shovel or a backhoe with no more than a substitution of a shovel structure for a backhoe and vice versa.

It should be understood that the present disclosure is for the purposes of illustration only and includes all modifications or improvements which fall within the scope of the appended claims.

What is claimed is:

1. An excavator comprising a boom pivotally supported at its proximal end to the platform of a supporting chassis for movement of the boom about a horizontal axis, an excavator, first means supporting the excavator adjacent the distal end of the boom for rectilinear and pivotal movement thereof relative to the distal end of the boom, said first means comprising a first rigid arm pivotally connected at one end to the distal end of the boom for pivotal movement about a horizontal axis spaced from the distal end of the boom and a rigid second arm mounted to the distal end of the first arm for rectilinear movement relative thereto, first power-operable means operable to effect rectilinear movement of the excavator relative to said first means and second power-operable means operable to effect pivotal movement of the excavator relative to said first means and articulated links pivotally connected at their distal ends to, respectively, the distal end of the first rigid arm and the distal end of the second rigid arm and means pivotally connecting the second power-operable means to the distal end of the boom and to the articulation connecting the links.

2. An excavator according to claim 1 comprising means pivotally supporting the proximal end of the boom to the platform for movement about a vertical axis.

3. An excavator according to claim 1 comprising means supporting the chassis for mobilization.

4. An excavator according to claim 1 wherein an inextensible link is pivotally connected at one end to the distal end of the upper arm and at its opposite end to the excavator at a radial distance from the pivot connecting the excavator to the distal end of the lower arm.

5. A hydraulic excavator according to claim 1 wherein the excavator is a backhoe bucket.

6. An excavator according to claim 1 wherein the excavator is a shovel.

7. A hydraulically-operated excavator comprising a boom pivotally supported at its proximal end to the platform of a supporting chassis for movement about vertical and horizontal axes, an excavator, and means supporting the excavator at the distal end of the boom for manipulation, comprising a rigd first arm, means pivotally connecting the proximal end of the first arm to the distal end of the boom for movement about a horizontal axis spaced from the distal end of the boom, a second arm mounted to the first arm for rectilinear movement relative thereto with its proximal and slidably engaged with the distal end of the first arm, means pivotally connecting the excavator to the distal end of the second arm about an axis spaced from the longitudinal axis of the second arm, an inextensible link pivotally connected at one end to the excavator and at its other end to the distal ends of the first arm, articulated links pivotally connected to each other at their proximal ends and to the distal ends of the first and second arms, a first power-operable cylinder connected at one end to the proximal end of the articulated links and to the distal end of the boom and the second power-operable cylinder connected to the proximal end of the second arm and the distal end of the first arm.

8. A hydraulic excavator according to claim 7 wherein the first arm is of hollow, tubular construction, the second arm is telescopically mounted within the first arm and said first power-operable cylinder is mounted within the first arm with one end connected to the proximal end of the second arm and the other end to the proximal end of the first arm.

* * * * *